US010223973B2

(12) United States Patent
Hong et al.

(10) Patent No.: US 10,223,973 B2
(45) Date of Patent: Mar. 5, 2019

(54) DEMULTIPLEXER AND DISPLAY DEVICE

(71) Applicant: Wuhan China Star Optoelectronics Technology Co., Ltd., Wuhan, Hubei (CN)

(72) Inventors: Guanghui Hong, Guangdong (CN); Qiang Gong, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 123 days.

(21) Appl. No.: 15/525,581

(22) PCT Filed: Apr. 20, 2017

(86) PCT No.: PCT/CN2017/081246
§ 371 (c)(1),
(2) Date: May 9, 2017

(87) PCT Pub. No.: WO2018/170986
PCT Pub. Date: Sep. 27, 2018

(65) Prior Publication Data

US 2018/0293943 A1 Oct. 11, 2018

(30) Foreign Application Priority Data

Mar. 23, 2017 (CN) ..... 2017 1 0178204

(51) Int. Cl.
*G09G 3/36* (2006.01)
*G09G 3/3266* (2016.01)

(52) U.S. Cl.
CPC ..... *G09G 3/3266* (2013.01); *G09G 3/3674* (2013.01); *G09G 2310/0297* (2013.01); *G09G 2310/06* (2013.01); *G09G 2330/021* (2013.01)

(58) Field of Classification Search
CPC ..... G09G 3/3674; G09G 2310/0297
See application file for complete search history.

(56) References Cited

U.S. PATENT DOCUMENTS

2004/0104880 A1 6/2004 Kang et al.
2005/0119867 A1 6/2005 Shin
2005/0259052 A1 11/2005 Shin
(Continued)

FOREIGN PATENT DOCUMENTS

CN 106383624 A 2/2017

*Primary Examiner* — Kevin M Nguyen
(74) *Attorney, Agent, or Firm* — Andrew C. Cheng

(57) ABSTRACT

A demultiplexer and a display device are provided. The demultiplexer is connected with a scanning driving circuit, and the scanning driving circuit includes multiple scanning driving units connected sequentially. The demultiplexer includes a control signal unit for outputting a first group of control signals and a second group of control signals, and a switching unit including a first switching group and a second switching group. When odd rows of the scanning driving units output scanning signals, the first group of control signals controls the first switching group to be turned on to charge the pixel unit. When even rows of scanning driving units output scanning signals, the second group of control signals controls the second switching group to be turned on to charge the pixel unit in order to decrease a refresh rate of the first group of control signals and the second group of control signals.

20 Claims, 5 Drawing Sheets

(56) References Cited

U.S. PATENT DOCUMENTS

| | | | | |
|---|---|---|---|---|
| 2005/0264495 | A1* | 12/2005 | Shin | G09G 3/325 345/76 |
| 2007/0057877 | A1 | 3/2007 | Choi et al. | |
| 2014/0035896 | A1 | 2/2014 | Lin et al. | |
| 2015/0287378 | A1* | 10/2015 | Jeong | G09G 3/3688 345/694 |
| 2016/0093260 | A1* | 3/2016 | Watsuda | G09G 3/3688 345/87 |
| 2017/0140706 | A1* | 5/2017 | Song | G09G 3/3233 |

* cited by examiner

DEMULTIPLEXER AND DISPLAY DEVICE

BACKGROUND OF THE INVENTION

1. Field of the Invention

The present invention relates to a display technology field, and more particularly to a demultiplexer and a display device.

2. Description of Related Art

A demultiplexer is used for reducing the number of output leads of a driving chip in the manufacturing process of a thin-film transistor liquid crystal display device. A common demultiplexer has two types. The first type is a demultiplexer that is controlled through N-type thin-film transistors, requiring three control signals (CKR, CKG, CKB) to realize multiple outputs of the driving chip. The second type is a demultiplexer controlled by a transmission gate, and six control signals (CKR, CKG, CKB, XCKR, XCKG, XCKB) are required in order to realize multiple outputs of the driving chip so as to greatly reduce the number of the output leads of the driving chip. Besides, the power consumption of the display device is a very important index. The display device having low power consumption is more competitive in the market so that decreasing the power consumption of the display device is a problem urgent to be solved.

SUMMARY OF THE INVENTION

The main technology solution solved by the present invention is to provide a demultiplexer and a display device in order to effectively decrease the power consumption of the display device.

In order to solve the above technology problem, a technology solution adopted by the present invention is: providing a demultiplexer applied in a display panel, the demultiplexer is connected with a scanning driving circuit, and the scanning driving circuit comprises multiple scanning driving units connected sequentially, wherein, the demultiplexer comprises:

a data signal terminal for outputting a data signal;

a control signal unit for outputting a first group of control signals and a second group of control signals;

a switching unit connected with the data signal terminal and the control signal unit, and the switching unit includes a first switching group and a second switching group; and a pixel unit connected with the first switching group and the second switching group;

wherein, when odd rows of the scanning driving units of the scanning driving circuit output scanning signals, the first group of control signals controls the first switching group to be turned on, and the second group of control signals controls the second switching group to be turned off such that the data signal outputted by the data signal terminal charges the pixel unit connected with the odd rows of the scanning driving units of the scanning driving circuit through the first switching group;

when even rows of scanning driving units of the scanning driving circuit output scanning signals, the second group of control signals controls the second switching group to be turned on, and the first group of control signals controls the first switching group to be turned off such that the data signal outputted by the data signal terminal charges the pixel unit connected with the even rows of the scanning driving unit of the scanning driving circuit through the second switching group such that a refresh rate of the first group of control signals and the second group of control signals are decreased.

In order to solve the above technology problem, a technology solution adopted by the present invention is: providing a display device, wherein the display device includes a demultiplexer applied in a display panel, the demultiplexer is connected with a scanning driving circuit, and the scanning driving circuit comprises multiple scanning driving units connected sequentially, wherein, the demultiplexer comprises:

a data signal terminal for outputting a data signal;

a control signal unit for outputting a first group of control signals and a second group of control signals;

a switching unit connected with the data signal terminal and the control signal unit, and the switching unit includes a first switching group and a second switching group; and a pixel unit connected with the first switching group and the second switching group;

wherein, when odd rows of the scanning driving units of the scanning driving circuit output scanning signals, the first group of control signals controls the first switching group to be turned on, and the second group of control signals controls the second switching group to be turned off such that the data signal outputted by the data signal terminal charges the pixel unit connected with the odd rows of the scanning driving units of the scanning driving circuit through the first switching group;

when even rows of scanning driving units of the scanning driving circuit output scanning signals, the second group of control signals controls the second switching group to be turned on, and the first group of control signals controls the first switching group to be turned off such that the data signal outputted by the data signal terminal charges the pixel unit connected with the even rows of the scanning driving unit of the scanning driving circuit through the second switching group such that a refresh rate of the first group of control signals and the second group of control signals are decreased.

The advantageous effect of the present invention is: comparing with the conventional art, in the demultiplexer and the display device of the present invention, the control signal unit outputs a first group of control signals and a second group of control signals in order to control corresponding first switching group and second switching group to be alternatively turned on so as to charge the pixel units connected with odd rows of the scanning driving units or even rows of the scanning driving units of the scanning driving circuit. Accordingly, a refresh rate of the first group of the control signals and the second group of the control signals of the control signal unit is decreased in order to decrease the power consumption of the demultiplexer.

DETAILED DESCRIPTION OF THE PREFERRED EMBODIMENT

Figure 1:
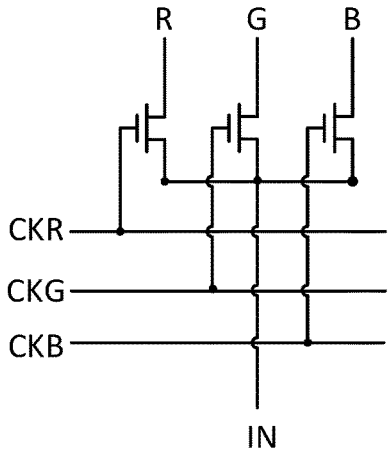
FIG.1(Prior Art)
FIG. 1 is a schematic circuit diagram of a demultiplexer according to a first embodiment of the conventional art.
Figure 2:
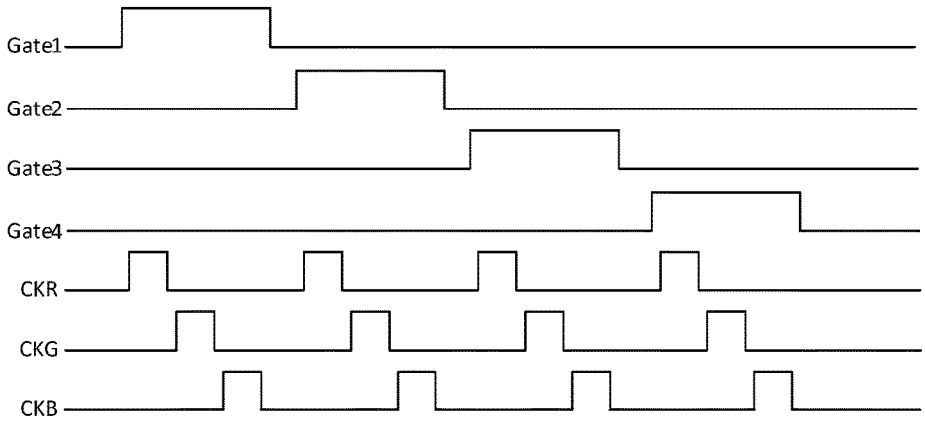
FIG. 2(Prior Art)
FIG. 2 is a timing diagram of FIG. 1.

With reference to FIG. 1 and FIG. 2, which are a schematic circuit diagram and a timing diagram of a demultiplexer of the conventional art. Wherein, the demultiplexer adopts three N-type thin-film transistors as a control unit, and adopting three control signals CKR, CKG and CKB to control the three N-type thin-film transistors to be tuned on or turned off in order to divide one signal into three portions. Wherein, when each row of scanning driving units of the scanning driving circuit outputs a scanning signal, the three N type thin-film transistors are all turned on such that data signal outputted by data signal terminal IN charges pixel units connected with each row of the scanning driving units of the scanning driving circuit through the three N-type thin-film transistors. The above circuit is not conducive for decreasing a refresh rate of the control signal so that the power consumption of the circuit is larger.

Figure 3:
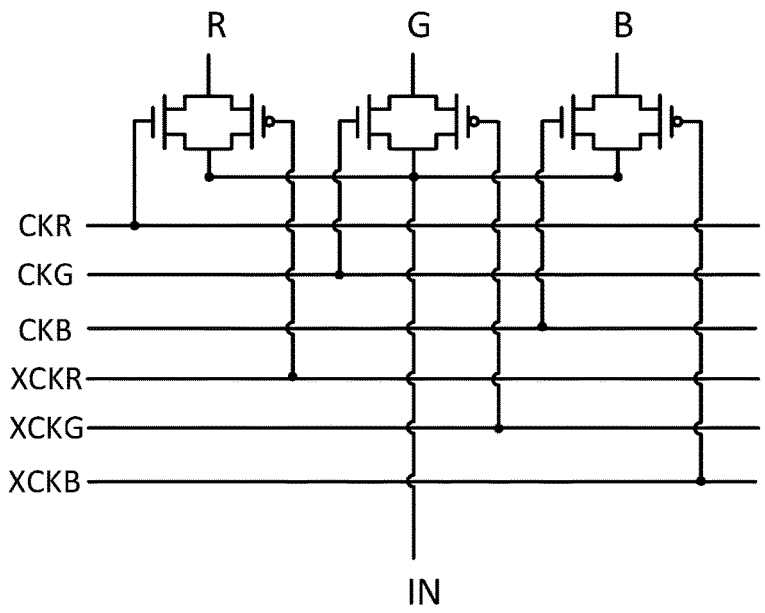
FIG. 3(Prior Art)
FIG. 3 is a schematic circuit diagram of a demultiplexer according to a second embodiment of the conventional art.
Figure 4:
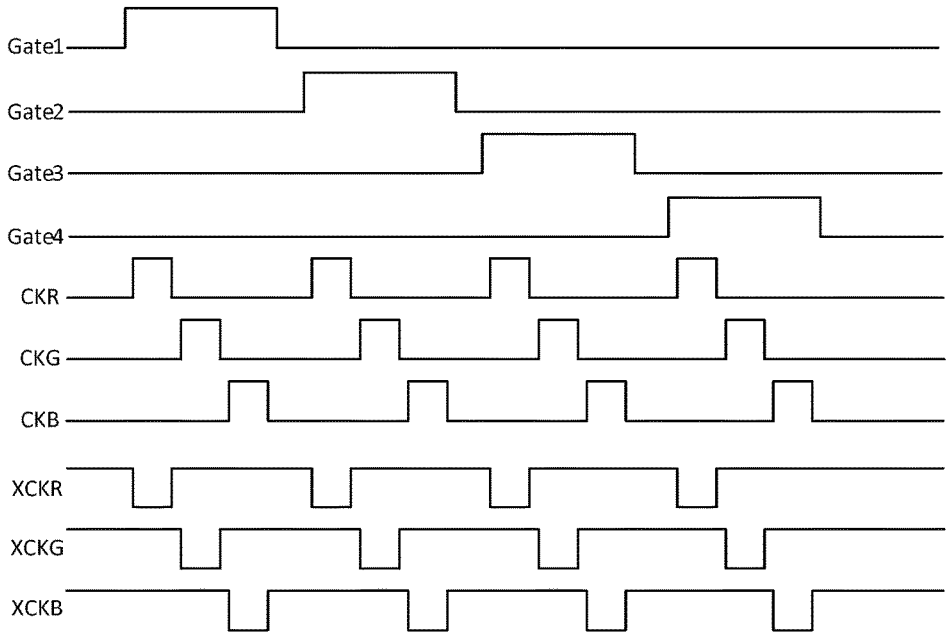
FIG. 4(Prior Art)
FIG. 4 is a timing diagram of FIG. 3.

With reference to FIG. 3 and FIG. 4, which are schematic circuit diagram and a timing diagram of a demultiplexer of the conventional art. Wherein, the demultiplexer adopts three transmission gates as a control unit, and adopting six control signals CKR, CKG, CKB, XCKR, XCKG and XCKB to control the three transmission gates to be tuned on or turned off in order to divide one signal into three portions. Wherein, when each row of scanning driving units of the scanning driving circuit outputs a scanning signal, the three transmission gates are all turned on such that data signal outputted by data signal terminal IN charges pixel unit connected with each row of the scanning driving units of the scanning driving circuit through the three N-type thin-film transistors. The above circuit is not conducive for decreasing a refresh rate of the control signal so that the power consumption of the circuit is larger.

Figure 5:
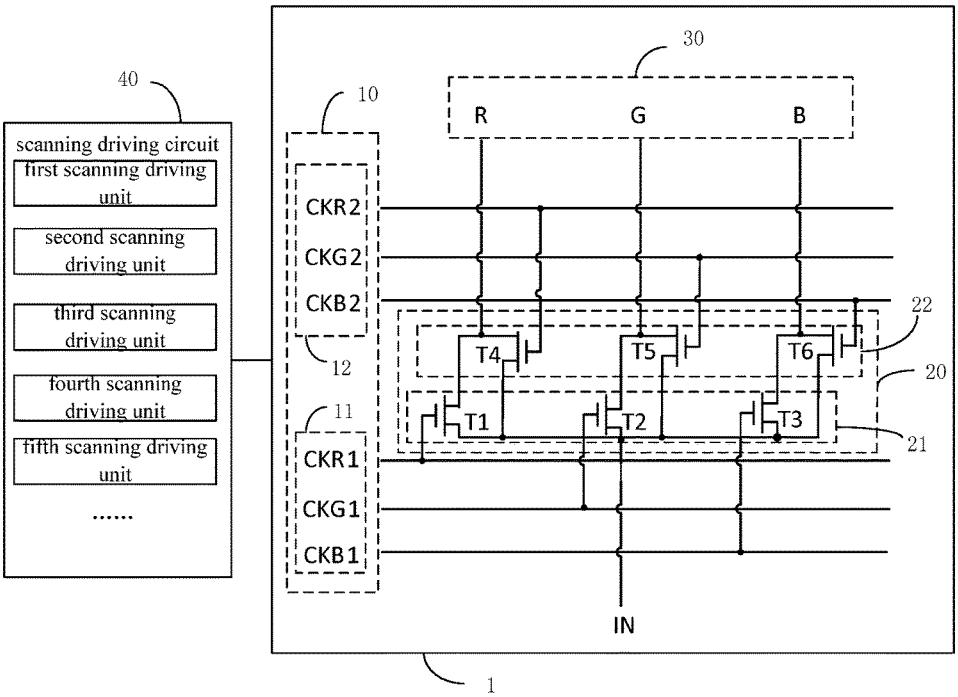
FIG. 5 is a schematic circuit diagram of a demultiplexer according to a first embodiment of the present invention.

With reference to FIG. 5, which is a schematic circuit diagram of a demultiplexer according to a first embodiment of the present invention. Wherein, the demultiplexer 1 is applied in a display panel. The demultiplexer 1 is connected to the scanning driving circuit 40. The scanning driving circuit 40 includes multiple scanning driving units sequentially connected, and the demultiplexer 1 comprises:

a data signal terminal IN for outputting a data signal;

a control signal unit 10 for outputting a first group of control signals 11 and a second group of control signals 12;

a switching unit 20 connected with the data signal terminal IN and the control signal unit 10, and the switching unit 20 includes a first switching group 21 and a second switching group 22; and a pixel unit 30 connected with the first switching group 21 and the second switching group 22;

wherein, when odd rows of the scanning driving units (such as a first row of the scanning driving unit, a third row of the scanning driving unit or a fifth row of scanning driving unit) of the scanning driving circuit 40 output scanning signals, the first group of control signals 11 controls the first switching group 21 to be turned on, and the second group of control signals 12 controls the second switching group 22 to be turned off such that the data signal outputted by the data signal terminal IN charges the pixel unit 30 connected with the odd rows of the scanning driving units of the scanning driving circuit through the first switching group 21; and when even rows of scanning driving units (such as a second row of the scanning driving unit, a fourth row of the scanning driving unit) of the scanning driving circuit 40 output scanning signals, the second group of control signals 12 controls the second switching group 22 to be turned on, and the first group of control signals 11 controls the first switching group 21 to be turned off such that the data signal outputted by the data signal terminal IN charges the pixel unit 30 connected with the even rows of the scanning driving unit of the scanning driving circuit through the second switching group 22. Accordingly, a refresh rate of the first group of control signals 11 and the second group of control signals 12 are decreased.

Specifically, the first group of control signals 11 includes a first to a third control signals CKR1, CKG1, CKB1, and the second group of control signals 12 includes a fourth to a sixth control signals CKR2, CKG2, CKB2. The first switching group 21 includes at least three controllable switches, and the second switching group 22 includes at least three controllable switches, and the pixel unit 30 includes at least three sub-pixels.

Specifically, the at least three controllable switches of the first switching group 21 is a first to a third controllable switches T1-T3, and the at least three controllable switches of the second switching group is a fourth to a sixth controllable switches T4-T6. The at least three sub-pixels of the pixel unit is a first to a third sub-pixels R, G, B. A control terminal of the first controllable switch T1 receives the first control signal CKR1, a first terminal of the first controllable switch T1 is connected with a first terminal of the fourth controllable switch T4 and the first sub-pixel R, a second terminal of the first controllable switch T1 is connected with a second terminal of the fourth controllable switch T4 and the data signal terminal IN. A control terminal of the fourth switch T4 receives the fourth control signal CKR2. A control terminal of the second controllable switch T2 receives the second control signal CKG1. A first terminal of the second controllable switch T2 is connected with a first terminal of the fifth controllable switch T5 and the second sub-pixel G. A second terminal of the second controllable switch T2 is connected with a second terminal of the fifth controllable switch T5 and the data signal terminal IN. A control terminal of the fifth controllable switch T5 receives the fifth control signal CKG2. A control terminal of the third controllable switch T3 receives the third control signal CKB1. A first terminal of the third controllable switch T3 is connected with a first terminal of the sixth controllable switch T6 and the third sub-pixel B. A second terminal of the third controllable switch T3 is connected with a second terminal of the sixth controllable switch T6 and the data signal terminal IN. A control terminal of the sixth controllable switch T6 receives the sixth control signal CKB2.

In the present embodiment, the first to the sixth controllable switches T1-T6 are all N-type thin-film transistors. The control terminal, the first terminal and the second terminal of each of the first to the sixth controllable switches T1-T6 are respectively corresponding to a gate electrode, a source electrode and a drain electrode of the N-type thin-film transistor. In another embodiment, the first to sixth controllable switches can be other types of switches, the only requirement is to realize the purpose of the present invention.

Wherein, the first to the third sub-pixels R, G, B are respectively a red sub-pixel, a green sub-pixel and a blue sub-pixel.

Figure 6:
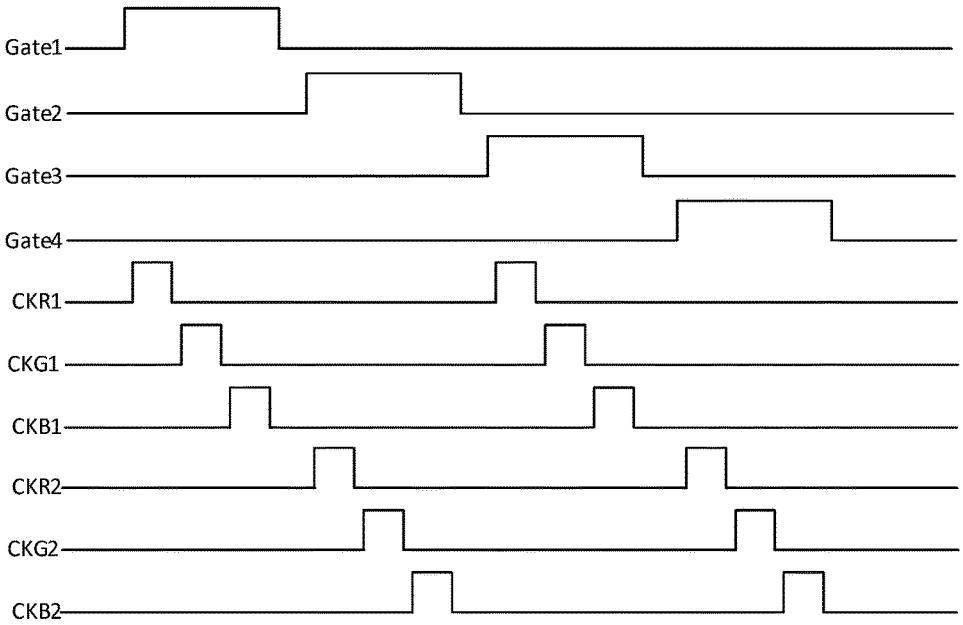
FIG. 6 is a timing diagram of FIG. 5.

With reference to FIG. 6, which is a schematic timing diagram of the demultiplexer according to a first embodiment of the present invention. As shown in FIG. 6, the operation principle of the demultiplexer 1 is as following. Wherein, the control signal unit 10 includes six control signals. The switching unit 20 includes six controllable switches and the pixel unit 30 includes three sub-pixels as an example. When odd rows of the scanning driving units of the scanning driving circuit 40 send output signals, the first control signal group of control signals 11 controls the first switching group 21 to be tuned on, the second group of control signals 12 controls the second switching group 22 to be turned off such that the data signal outputted from the data signal terminal IN charges the pixel unit 30 connected with the odd rows if the scanning driving units of the scanning driving circuit.

When the even rows of the scanning driving units of the scanning driving circuit 40 outputs scanning signals, the second group of control signals 12 controls the second switching group 22 to be turned on, the first group of control signals 11 controls the first switching group 21 to be turned off such that the data signal outputted by the data signal terminal IN charges the pixel unit 30 connected with even rows of the scanning driving units of the scanning driving circuit such that a refresh rate of the first group of control signals 11 and the second group of control signals 12 of the control signal unit 10 is decreased in order to decrease the power consumption of the demultiplexer.

Figure 7:
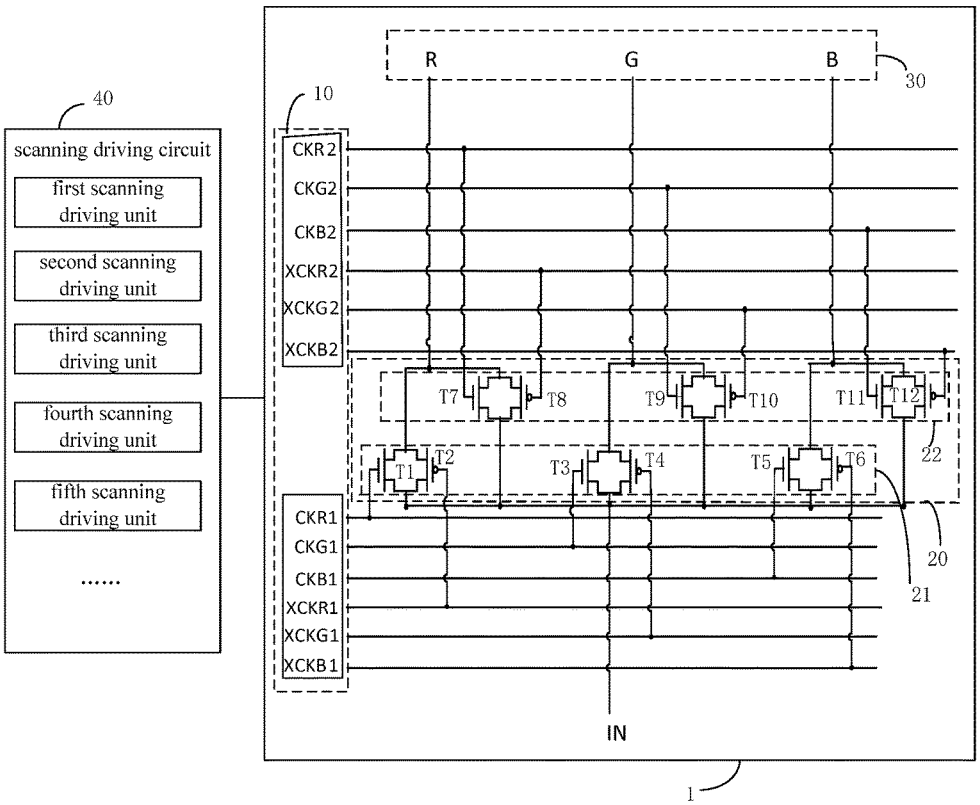
FIG. 7 is a schematic circuit diagram of a demultiplexer according to a second embodiment of the present invention.

With reference to FIG. 7, which a schematic circuit diagram of a demultiplexer according to a second embodiment of the present invention. The difference between the demultiplexer of the second embodiment and the above first embedment is: the first group of control signals 11 includes a first to a sixth control signals CKR1, XCKR1, CKG1, XCKG1, CKB1, XCKB1. The second group of control signals 12 includes a seventh to a twelfth control signals CKR2, XCKR2、CKG2、XCKG2、CKB2、XCKB2. The first switching group 21 includes at least six controllable switches. The second switching group 22 includes at least six controllable switches. The pixel unit 30 includes at least three sub-pixels.

Specifically, the at least six controllable switches of the first switching group 21 is a first to a sixth controllable switches. The at least six controllable switches of the second switching group 22 is a seventh to a twelfth controllable switches T7-T12. The at least three sub-pixels of the pixel unit 30 is a first to a third sub-pixels R, G, B. A control terminal of the first controllable switch T1 receives the first control signal CKR1, a first terminal of the first controllable switch T1 is connected with a first terminal of the second controllable switch T2 and the first sub-pixel R. A second terminal of the first controllable switch T1 is connected with a second terminal of the second controllable switch T2 and the data signal terminal IN, and a control terminal of the second controllable switch T2 receives the second control signal XCKR1; a control terminal of the third controllable switch T3 receives the third control signal CKG1, a first terminal of the third controllable switch T3 is connected with a first terminal of the fourth controllable switch T4 and the second sub-pixel G; a second terminal of the third controllable switch T3 is connected with a second terminal of the fourth controllable switch T4 and the data signal terminal IN, a control terminal of the fourth controllable switch T4 receives the fourth control signal XCKG1; a control terminal of the fifth controllable switch T5 receives the fifth control signal CKB1, a first terminal of the fifth controllable switch T5 is connected with a first terminal of the sixth controllable switch T6 and the third sub-pixel B, a second terminal of the fifth controllable switch T5 is connected with a second terminal of the sixth controllable switch T6 and the data signal terminal IN, a control terminal of the sixth controllable switch T6 receives the sixth controllable signal XCKB1; a control terminal of the seventh controllable switch T7 receives the seventh control signal CKR2, a first terminal of the seventh controllable switch T7 is connected with a first terminal of the eighth controllable switch T8 and the first pixel R, a second terminal of the seventh controllable switch T7 is connected with a second terminal of the eighth controllable switch T8 and the data signal terminal IN; a control terminal of the eighth controllable switch T8 receives the eighth control signal XCKR2, a control terminal of the ninth controllable switch T9 receives the ninth control signal CKG2, a first terminal of the ninth controllable switch T9 is connected with a first terminal of the tenth controllable switch T10 and the second sub-pixel G; a second terminal of the ninth controllable switch T9 is connected with a second terminal of the tenth controllable switch T10 and the data signal terminal IN, a control terminal of the tenth controllable switch T10 receives the tenth control signal XCKG2; a control terminal of the eleventh controllable switch T11 receives the twelfth control signal CKB2; a first terminal of the eleventh controllable switch T11 is connected with a first terminal of the twelfth controllable switch T12 and the third sub-pixel B, a second terminal of the eleventh controllable switch T11 is connected with a second terminal of the twelfth controllable switch T12 and the data signal terminal IN, and a control terminal of the twelfth controllable switch T12 receives the twelfth control signal XCB2.

In the present embodiment, the first controllable switch T1, the third controllable switch T3, the fifth controllable switch T5, the seventh controllable switch T7, the ninth controllable switch T9 and the eleventh controllable switch T11 are all N-type thin-film transistors. The control terminal, the first terminal and the second terminal of each of the first controllable switch T1, the third controllable switch T3, the fifth controllable switch T5, the seventh controllable switch T7, the ninth controllable switch T9 and the eleventh controllable switch T11 are respectively corresponding to a gate electrode, a source electrode and a drain electrode of the N-type thin-film transistor.

The second controllable switch T2, the fourth controllable switch T4, the sixth controllable switch T6, the eighth controllable switch T8, the tenth controllable switch T10 and the twelfth controllable switch T12 are all P-type thin-film transistors. The control terminal, the first terminal and the second terminal of each of the second controllable switch T2, the fourth controllable switch T4, the sixth controllable switch T6, the eighth controllable switch T8, the tenth controllable switch T10 and the twelfth controllable switch T12 are respectively corresponding to a gate electrode, a source electrode and a drain electrode of the P-type thin-film transistor. In another embodiment, the first to the twelfth controllable switches can also be other types of switches, and the only requirement is to realize the purpose of the present invention.

Wherein, phases of the first control signal CKR1 and the second control signal XCKR1 are opposite. Phases of the third control signal CKG1 and the fourth control signal XCKG1 are opposite. Phases of the fifth control signal CKB1 and the sixth control signal XCKB1 are opposite. Phases of the seventh control signal CKR2 and the eighth control signal XCKR2 are opposite. Phases of the ninth control signal CKG2 and the tenth control signal XCKG2 are opposite. Phases of the eleventh control signal CKB2 and the twelfth control signal XCKB2 are opposite.

Figure 8:
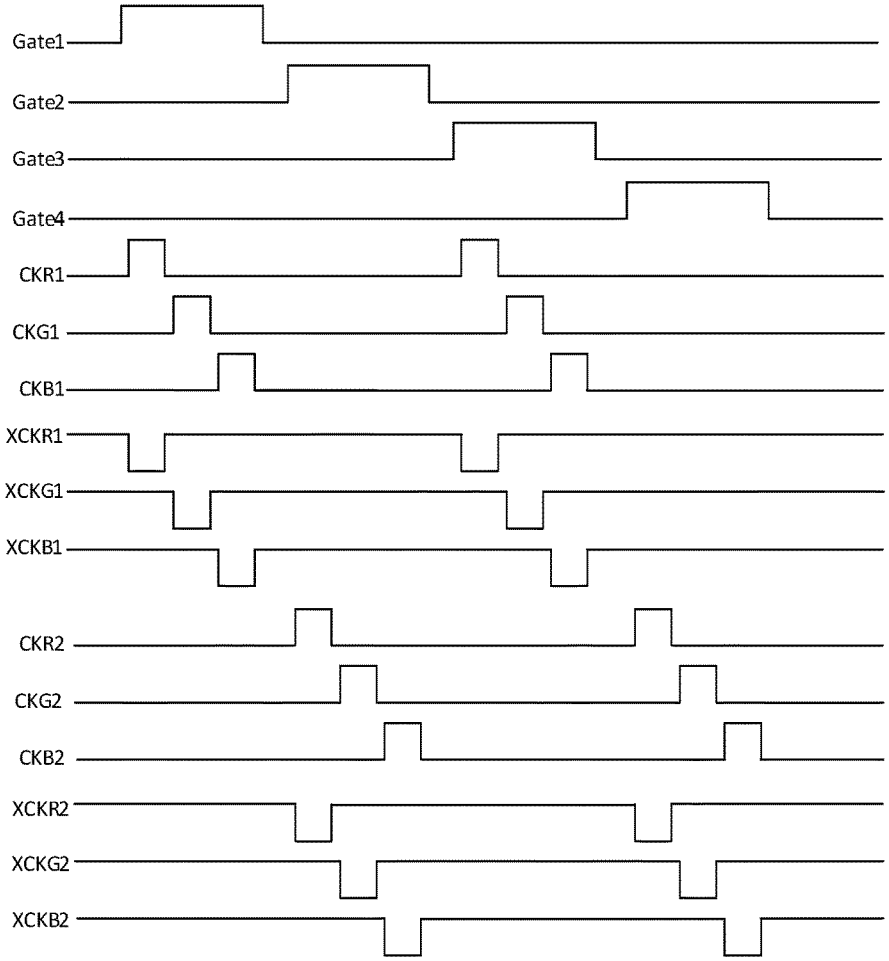
FIG. 8 is a timing diagram of FIG. 7.

With reference to FIG. 8, which is a schematic timing diagram of the demultiplexer of the first embodiment of the present invention. As shown in FIG. 8, the operation principle of the demultiplexer 1 is as following. Wherein, the control signal unit 10 includes twelve control signals. The switching unit 20 includes twelve controllable switches and the pixel unit 30 includes three sub-pixels as an example. When odd rows of the scanning driving units of the scanning driving circuit 40 output scanning signals, the first group of the control signals 11 controls the first switching group 21 to be turned on, the second group of the control signals 12 controls the second switching group 22 to be turned off such that the data signal outputted from the data signal terminal IN charges the pixel unit 30 connected with the odd rows of the scanning driving units of the scanning driving circuit.

When even rows of the scanning driving units of the scanning driving circuit 40 outputs scanning signals, the second groups of the control signals 12 controls the second switching group 22 to be turned on, the first group of the control signals 11 controls the first switching group 21 to be turned off such that the data signal outputted by the data signal terminal IN charges the pixel unit 30 connected with the even rows of the scanning driving units of the scanning driving circuit such that a refresh rate of the first group of the control signals 11 and the second group of the control signals 12 of the control signal unit 10 is decreased in order to decrease the power consumption of the demultiplexer.

Figure 9:
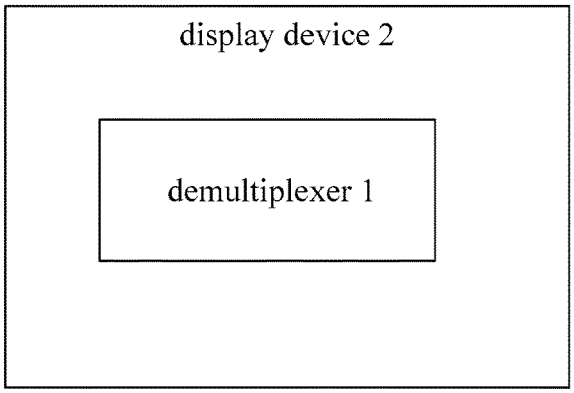
FIG. 9 is a schematic structure diagram of a display device of the present invention.

With reference to FIG. 9, which is a schematic structure diagram of a display device of the present invention. The display device 2 includes the demultiplexer 1 described above, the other devices and functions are of the display device 2 are the same as a conventional display device, no more repeating. Wherein, the display device is an LCD or an OLED, which can be applied in mobile phone, monitor or TV.

In the demultiplexer and the display device of the present invention, the control signal unit outputs a first group of control signals and a second group of control signals in order to control corresponding first switching group and second switching group to be alternatively turned on so as to charge the pixel units connected with odd rows of the scanning driving units or even rows of the scanning driving units of the scanning driving circuit. Accordingly, a refresh rate of the first group of the control signals and the second group of the control signals of the control signal unit is decreased in order to decrease the power consumption of the demultiplexer.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A demultiplexer applied in a display panel, the demultiplexer is connected with a scanning driving circuit, and the scanning driving circuit comprises multiple scanning driving units connected sequentially, wherein, the demultiplexer comprises:

a data signal terminal for outputting a data signal;

a control signal unit for outputting a first group of control signals and a second group of control signals;

a switching unit connected with the data signal terminal and the control signal unit, and the switching unit includes a first switching group and a second switching group; and a pixel unit connected with the first switching group and the second switching group;

wherein, when odd rows of the scanning driving units of the scanning driving circuit output scanning signals, the first group of control signals controls the first switching group to be turned on, and the second group of control signals controls the second switching group to be turned off such that the data signal outputted by the data signal terminal charges the pixel unit connected with the odd rows of the scanning driving units of the scanning driving circuit through the first switching group; and when even rows of scanning driving units of the scanning driving circuit output scanning signals, the second group of control signals controls the second switching group to be turned on, and the first group of control signals controls the first switching group to be turned off such that the data signal outputted by the data signal terminal charges the pixel unit connected with the even rows of the scanning driving unit of the scanning driving circuit through the second switching group such that a refresh rate of the first group of control signals and the second group of control signals are decreased.

2. The demultiplexer according to claim 1, wherein, the first group of control signals includes a first to a third control signals, the second group of control signals includes a fourth to a sixth control signals, the first switching group includes at least three controllable switches, and the second switching group includes at least three controllable switches, and the pixel unit includes at least three sub-pixels.

3. The demultiplexer according to claim 2, wherein, the at least three controllable switches of the first switch group is a first to a third controllable switches, the at least three controllable switches of the second switch group is a fourth to a sixth controllable switches, and the at least three sub-pixels of the pixel unit is a first to a third sub-pixels; a control terminal of the first controllable switch receives the first control signal, a first terminal of the first controllable switch is connected with a first terminal of the fourth controllable switch and the first sub-pixel, a second terminal of the first controllable switch is connected with a second terminal of the fourth controllable switch and the data signal terminal; a control terminal of the fourth switch receives the fourth control signal, a control terminal of the second controllable switch receives the second control signal, a first terminal of the second controllable switch is connected with a first terminal of the fifth controllable switch and the second sub-pixel; a second terminal of the second controllable switch is connected with a second terminal of the fifth controllable switch and the data signal terminal, a control terminal of the fifth controllable switch receives the fifth control signal; a control terminal of the third controllable switch receives the third control signal, a first terminal of the third controllable switch is connected with a first terminal of the sixth controllable switch and the third sub-pixel B; a second terminal of the third controllable switch is connected with a second terminal of the sixth controllable switch and the data signal terminal, a control terminal of the sixth controllable switch receives the sixth control signal.

4. The demultiplexer according to claim 3, wherein, the first to the sixth controllable switches T1-T6 are all N-type thin-film transistors; the control terminal, the first terminal and the second terminal of each of the first to the sixth controllable switches are respectively corresponding to a gate electrode, a source electrode and a drain electrode of the N-type thin-film transistor.

5. The demultiplexer according to claim 1, wherein, the first group of control signals includes a first to a sixth control signals; the second group of control signals includes a seventh to a twelfth control signals; the first switch group includes at least six controllable switches, the second switch group includes at least six controllable switches, and the pixel unit includes at least three sub-pixels.

6. The demultiplexer according to claim 5, wherein, the at least six controllable switches of the first switch group is a first to a sixth controllable switches, the at least six controllable switches of the second switch group is a seventh to a twelfth controllable switches, and the at least three sub-pixels of the pixel unit is a first to a third sub-pixels; a control terminal of the first controllable switch receives the first control signal, a first terminal of the first controllable switch is connected with a first terminal of the second controllable switch and the first sub-pixel; a second terminal of the first controllable switch is connected with a second terminal of the second controllable switch and the data signal terminal, and a control terminal of the second controllable switch receives the second control signal; a control terminal of the third controllable switch receives the third control signal, a first terminal of the third controllable switch is connected with a first terminal of the fourth controllable switch and the second sub-pixel; a second terminal of the third controllable switch is connected with a second terminal of the fourth controllable switch and the data signal terminal, a control terminal of the fourth controllable switch receives the fourth control signal; a control terminal of the fifth controllable switch receives the fifth control signal, a first terminal of the fifth controllable switch is connected with a first terminal of the sixth controllable switch and the third sub-pixel, a second terminal of the fifth controllable switch is connected with a second terminal of the sixth controllable switch and the data signal terminal, a control terminal of the sixth controllable switch receives the sixth controllable signal; and a control terminal of the seventh controllable switch receives the seventh control signal, a first terminal of the seventh controllable switch is connected with a first terminal of the eighth controllable switch and the first pixel, a second terminal of the seventh controllable switch is connected with a second terminal of the eighth controllable switch and the data signal terminal; a control terminal of the eighth controllable switch receives the eighth control signal, a control terminal of the ninth controllable switch receives the ninth control signal, a first terminal of the ninth controllable switch is connected with a first terminal of the tenth controllable switch and the second sub-pixel; a second terminal of the ninth controllable switch is connected with a second terminal of the tenth controllable switch and the data signal terminal, a control terminal of the tenth controllable switch receives the tenth control signal; a control terminal of the eleventh controllable switch receives the twelfth control signal; a first terminal of the eleventh controllable switch is connected with a first terminal of the twelfth controllable switch and the third sub-pixel, a second terminal of the eleventh controllable switch is connected with a second terminal of the twelfth controllable switch and the data signal terminal, and a control terminal of the twelfth controllable switch receives the twelfth control signal.

7. The demultiplexer according to claim 6, wherein the first controllable switch, the third controllable switch, the fifth controllable switch, the seventh controllable switch, the ninth controllable switch and the eleventh controllable switch are all N-type thin-film transistors; the control terminal, the first terminal and the second terminal of each of the first controllable switch, the third controllable switch, the fifth controllable switch, the seventh controllable switch, the ninth controllable switch and the eleventh controllable switch are respectively corresponding to a gate electrode, a source electrode and a drain electrode of the N-type thin-film transistor; and the second controllable switch, the fourth controllable switch, the sixth controllable switch, the eighth controllable switch, the tenth controllable switch and the twelfth controllable switch are all P-type thin-film transistors; the control terminal, the first terminal and the second terminal of each of the second controllable switch, the fourth controllable switch, the sixth controllable switch, the eighth controllable switch, the tenth controllable switch and the twelfth controllable switch are respectively corresponding to a gate electrode, a source electrode and a drain electrode of the P-type thin-film transistor.

8. The demultiplexer according to claim 5, wherein phases of the first control signal and the second control signal are opposite; phases of the third control signal and the fourth control signal are opposite; phases of the fifth control signal and the sixth control signal are opposite; phases of the seventh control signal and the eighth control signal are opposite; phases of the ninth control signal and the tenth control signal are opposite; phases of the eleventh control signal and the twelfth control signal are opposite.

9. The demultiplexer according to claim 3, wherein, the first to the third sub-pixels are respectively a red sub-pixel, a green sub-pixel and a blue sub-pixel.

10. The demultiplexer according to claim 6, wherein, the first to the third sub-pixels are respectively a red sub-pixel, a green sub-pixel and a blue sub-pixel.

11. A display device, wherein the display device includes a demultiplexer applied in a display panel, the demultiplexer is connected with a scanning driving circuit, and the scanning driving circuit comprises multiple scanning driving units connected sequentially, wherein, the demultiplexer comprises:

a data signal terminal for outputting a data signal;

a control signal unit for outputting a first group of control signals and a second group of control signals;

a switching unit connected with the data signal terminal and the control signal unit, and the switching unit includes a first switching group and a second switching group; and a pixel unit connected with the first switching group and the second switching group;

wherein, when odd rows of the scanning driving units of the scanning driving circuit output scanning signals, the first group of control signals controls the first switching group to be turned on, and the second group of control signals controls the second switching group to be turned off such that the data signal outputted by the data signal terminal charges the pixel unit connected with the odd rows of the scanning driving units of the scanning driving circuit through the first switching group; and when even rows of scanning driving units of the scanning driving circuit output scanning signals, the second group of control signals controls the second switching group to be turned on, and the first group of control signals controls the first switching group to be turned off such that the data signal outputted by the data signal terminal charges the pixel unit connected with the even rows of the scanning driving unit of the scanning driving circuit through the second switching group such that a refresh rate of the first group of control signals and the second group of control signals are decreased.

12. The display device according to claim 11, wherein, the first group of control signals includes a first to a third control signals, the second group of control signals includes a fourth to a sixth control signals, the first switching group includes at least three controllable switches, and the second switching group includes at least three controllable switches, and the pixel unit includes at least three sub-pixels.

13. The display device according to claim 12, wherein, the at least three controllable switches of the first switch group is a first to a third controllable switches, the at least three controllable switches of the second switch group is a fourth to a sixth controllable switches, and the at least three sub-pixels of the pixel unit is a first to a third sub-pixels; a control terminal of the first controllable switch receives the first control signal, a first terminal of the first controllable switch is connected with a first terminal of the fourth controllable switch and the first sub-pixel, a second terminal of the first controllable switch is connected with a second terminal of the fourth controllable switch and the data signal terminal; a control terminal of the fourth switch receives the fourth control signal, a control terminal of the second controllable switch receives the second control signal, a first terminal of the second controllable switch is connected with a first terminal of the fifth controllable switch and the second sub-pixel; a second terminal of the second controllable switch is connected with a second terminal of the fifth controllable switch and the data signal terminal, a control terminal of the fifth controllable switch receives the fifth control signal; a control terminal of the third controllable switch receives the third control signal, a first terminal of the third controllable switch is connected with a first terminal of the sixth controllable switch and the third sub-pixel B; a second terminal of the third controllable switch is connected with a second terminal of the sixth controllable switch and the data signal terminal, a control terminal of the sixth controllable switch receives the sixth control signal.

14. The display device according to claim 13, wherein, the first to the sixth controllable switches are all N-type thin-film transistors; the control terminal, the first terminal and the second terminal of each of the first to the sixth controllable switches are respectively corresponding to a gate electrode, a source electrode and a drain electrode of the N-type thin-film transistor.

15. The display device according to claim 11, wherein, the first group of control signals includes a first to a sixth control signals; the second group of control signals includes a seventh to a twelfth control signals; the first switch group includes at least six controllable switches, the second switch group includes at least six controllable switches, and the pixel unit includes at least three sub-pixels.

16. The display device according to claim 15, wherein, the at least six controllable switches of the first switch group is a first to a sixth controllable switches, the at least six controllable switches of the second switch group is a seventh to a twelfth controllable switches, and the at least three sub-pixels of the pixel unit is a first to a third sub-pixels; a control terminal of the first controllable switch receives the first control signal, a first terminal of the first controllable switch is connected with a first terminal of the second controllable switch and the first sub-pixel; a second terminal of the first controllable switch is connected with a second terminal of the second controllable switch and the data signal terminal, and a control terminal of the second controllable switch receives the second control signal; a control terminal of the third controllable switch receives the third control signal, a first terminal of the third controllable switch is connected with a first terminal of the fourth controllable switch and the second sub-pixel; a second terminal of the third controllable switch is connected with a second terminal of the fourth controllable switch and the data signal terminal, a control terminal of the fourth controllable switch receives the fourth control signal; a control terminal of the fifth controllable switch receives the fifth control signal, a first terminal of the fifth controllable switch is connected with a first terminal of the sixth controllable switch and the third sub-pixel, a second terminal of the fifth controllable switch is connected with a second terminal of the sixth controllable switch and the data signal terminal, a control terminal of the sixth controllable switch receives the sixth controllable signal; and a control terminal of the seventh controllable switch receives the seventh control signal, a first terminal of the seventh controllable switch is connected with a first terminal of the eighth controllable switch and the first pixel, a second terminal of the seventh controllable switch is connected with a second terminal of the eighth controllable switch and the data signal terminal; a control terminal of the eighth controllable switch receives the eighth control signal, a control terminal of the ninth controllable switch receives the ninth control signal, a first terminal of the ninth controllable switch is connected with a first terminal of the tenth controllable switch and the second sub-pixel; a second terminal of the ninth controllable switch is connected with a second terminal of the tenth controllable switch and the data signal terminal, a control terminal of the tenth controllable switch receives the tenth control signal; a control terminal of the eleventh controllable switch receives the twelfth control signal; a first terminal of the eleventh controllable switch is connected with a first terminal of the twelfth controllable switch and the third sub-pixel, a second terminal of the eleventh controllable switch is connected with a second terminal of the twelfth controllable switch and the data signal terminal, and a control terminal of the twelfth controllable switch receives the twelfth control signal.

17. The display device according to claim 16, wherein, the first controllable switch, the third controllable switch, the fifth controllable switch, the seventh controllable switch, the ninth controllable switch and the eleventh controllable switch are all N-type thin-film transistors; the control terminal, the first terminal and the second terminal of each of the first controllable switch, the third controllable switch, the fifth controllable switch, the seventh controllable switch, the ninth controllable switch and the eleventh controllable switch are respectively corresponding to a gate electrode, a source electrode and a drain electrode of the N-type thin-film transistor; and the second controllable switch, the fourth controllable switch, the sixth controllable switch, the eighth controllable switch, the tenth controllable switch and the twelfth controllable switch are all P-type thin-film transistors; the control terminal, the first terminal and the second terminal of each of the second controllable switch, the fourth controllable switch, the sixth controllable switch, the eighth controllable switch, the tenth controllable switch and the twelfth controllable switch are respectively corresponding to a gate electrode, a source electrode and a drain electrode of the P-type thin-film transistor.

18. The display device according to claim 15, wherein phases of the first control signal and the second control signal are opposite; phases of the third control signal and the fourth control signal are opposite; phases of the fifth control signal and the sixth control signal are opposite; phases of the seventh control signal and the eighth control signal are opposite; phases of the ninth control signal and the tenth control signal are opposite; phases of the eleventh control signal and the twelfth control signal are opposite.

19. The display device according to claim 13, wherein, the first to the third sub-pixels are respectively a red sub-pixel, a green sub-pixel and a blue sub-pixel.

20. The display device according to claim 16, wherein, the first to the third sub-pixels are respectively a red sub-pixel, a green sub-pixel and a blue sub-pixel.

* * * * *